US007104721B2

(12) United States Patent
Rogers et al.

(10) Patent No.: US 7,104,721 B2
(45) Date of Patent: Sep. 12, 2006

(54) TURNTABLE BARRIER SYSTEM

(75) Inventors: Robert M. Rogers, New York, NY (US); Alissa Bucher, New York, NY (US); Graeme Waitzkin, New York, NY (US); Jonathan J. Marvel, New York, NY (US); Richard Ramsey, New York, NY (US)

(73) Assignee: Rock Twelve, LLC, New York, NY (US)

( * ) Notice: Subject to any disclaimer, the term of this patent is extended or adjusted under 35 U.S.C. 154(b) by 0 days.

(21) Appl. No.: 11/368,558

(22) Filed: Mar. 6, 2006

(65) Prior Publication Data

US 2006/0153637 A1 Jul. 13, 2006

Related U.S. Application Data

(62) Division of application No. 10/838,651, filed on May 4, 2004, now Pat. No. 7,040,836.

(51) Int. Cl.
*E01F 13/00* (2006.01)
*W01F 15/00* (2006.01)

(52) U.S. Cl. ..... 404/6; 404/9; 104/35

(58) Field of Classification Search ..... 404/6, 404/9; 104/35, 44, 47
See application file for complete search history.

(56) References Cited

U.S. PATENT DOCUMENTS 4,172,422 A * 10/1979 McBride ..... 104/44
4,195,442 A * 4/1980 Keeling et al. ..... 49/35
4,576,509 A * 3/1986 Beaty, Sr. ..... 404/6
4,608,929 A * 9/1986 Park ..... 104/44
4,629,357 A * 12/1986 Wattenburg et al. ..... 404/6
4,632,598 A * 12/1986 Richards ..... 404/6
4,777,884 A * 10/1988 Seay, Jr. ..... 104/42
4,818,137 A * 4/1989 Gorlov ..... 404/6
4,828,424 A * 5/1989 Crisp, Sr. ..... 404/6
4,841,870 A * 6/1989 Coles ..... 104/44
4,881,845 A * 11/1989 McKay ..... 404/6
4,893,119 A * 1/1990 Nasatka ..... 340/928
4,923,327 A * 5/1990 Gorlov ..... 404/6
4,955,753 A * 9/1990 McKay ..... 404/6
5,009,542 A * 4/1991 Hardin et al. ..... 404/6
5,074,704 A * 12/1991 McKay ..... 404/6
5,086,704 A * 2/1992 Mueller ..... 104/44
5,299,882 A * 4/1994 Sayers ..... 404/6
5,469,676 A * 11/1995 Colsman ..... 52/174
5,762,443 A * 6/1998 Gelfand et al. ..... 404/6
6,467,746 B1 * 10/2002 Paskiewicz ..... 248/349.1

* cited by examiner

*Primary Examiner*—Raymond Addie
(74) *Attorney, Agent, or Firm*—Foley & Lardner LLP

(57) ABSTRACT

An operable barrier system for vehicles includes a turntable for use with a trafficable surface and at least one impact element disposed on the turntable. A drive system is provided to rotate the turntable along the trafficable surface between a first position to prevent passage by vehicles and a second position, approximately 90 degrees from the first position, to permit passage by vehicles. A method of providing an operable vehicle barrier for use with a roadway includes providing a turntable device having a top surface, mounting at least one impact element on the top surface, and providing a drive system capable of rotating the turntable device in a plane that can be driven across by vehicles from the roadway.

26 Claims, 6 Drawing Sheets

TURNTABLE BARRIER SYSTEM

CROSS REFERENCE TO RELATED APPLICATION

The present Application is a division of, and claims the benefit of priority available under 35 U.S.C. § 121 to, U.S. patent application Ser. No. 10/838,651 titled "Turntable Barrier System" filed May 4, 2004 now U.S. Pat. No. 7,040,836, which is incorporated herein by reference in its entirety.

FIELD

The present invention relates to a barrier system that controls passage of vehicles and may control passage of pedestrians. The present invention of the barrier system uses impact elements to restrict the passage of vehicles. The impact elements are mounted on a turntable for rotation between a vehicle restricting position and a vehicle passage position.

BACKGROUND

Barriers for restricting the passage of vehicles (such as automobiles, trucks, busses and the like) are generally known. Such barriers are typically categorized as "inoperable barriers" in which the position of the barrier typically does not change, and "operable barriers" in which the position of the barrier is typically configured to change. Known inoperable barriers include "inertial" or "friction" type barriers such as "jersey barriers" and concrete planters that are often provided for managing traffic flow or patterns, such as at roadway construction areas, and fixed posts, that are typically embedded in a foundation, etc. Known operable barriers typically include gates (swinging, lifting, etc.) and retractable posts (known as bollards) that are intended to control access by restricting vehicular access to an area (e.g. "secure" or "controlled" area, etc.) unless authorized, in which case the position of the barrier changes (e.g. opens) to permit access and then returns (e.g. closes). However, such known vehicle barriers do not realize certain advantageous features (and/or combinations of features). For example, inoperable barriers that are not readily movable tend to increase delays and inconvenience to those requiring vehicular access to an area. Also, such known operable barriers, such as gates and the like may be subject to breach by vehicles traveling at increased speeds (e.g. gate crashing, etc.). For example, the increasing threat of certain acts of terrorism and other security-related events that are carried out with vehicles tend to challenge the integrity of such known operable barriers that are intended to help protect life and property.

Accordingly, it would be desirable to provide a turntable barrier system or the like of a type disclosed in the present Application that includes any one or more of these or other advantageous features:

1. A system providing a barrier that is resistant to unauthorized breach by vehicles.

2. A system movable between a first position intended to prevent passage of a vehicle and a second position intended to permit passage of a vehicle.

3. A system providing spaced apart barriers that permits maximum and unchecked pedestrian access/passage, but restricts vehicle access/passage.

4. A system that is integrated into a vehicle traffic surface (e.g. roadway surface, etc.).

5. A system that occupies a minimal depth within a roadway surface.

6. A system that provides an economical operable vehicle barrier system.

7. A system that provides a less visually obtrusive operable vehicle barrier system.

8. A system providing spaced-apart barriers mounted on a rotatable platform (e.g. turntable, etc.) that is rotatable in plane of the roadway between a first position where the barriers form a line generally perpendicular to traffic flow to restrict access, and a second position where the barriers form a line generally parallel to traffic flow to permit access.

9. A system providing barriers having sufficient mass and strength to resist impact from vehicles.

10. A system having barriers that are integrated with a turntable.

11. A system that permits operation of the barrier remotely from the barrier or manually at the barrier.

SUMMARY

The present invention also relates to an operable barrier system for vehicles. The system includes a turntable for use with a trafficable surface and at least one impact element disposed on the turntable. A drive system is provided to rotate the turntable along a plane of the trafficable surface between a first position configured to prevent passage by vehicles and a second position, approximately 90 degrees from the first position, configured to permit passage by vehicles.

The present invention also relates to a method of providing an operable vehicle barrier for use with a roadway to control passage of vehicles. The method includes providing a turntable device having a top surface, mounting at least one impact element on the top surface, and providing a drive system capable of rotating the turntable device in a plane that can be driven across by vehicles from the roadway.

DETAILED DESCRIPTION

Figure 1:
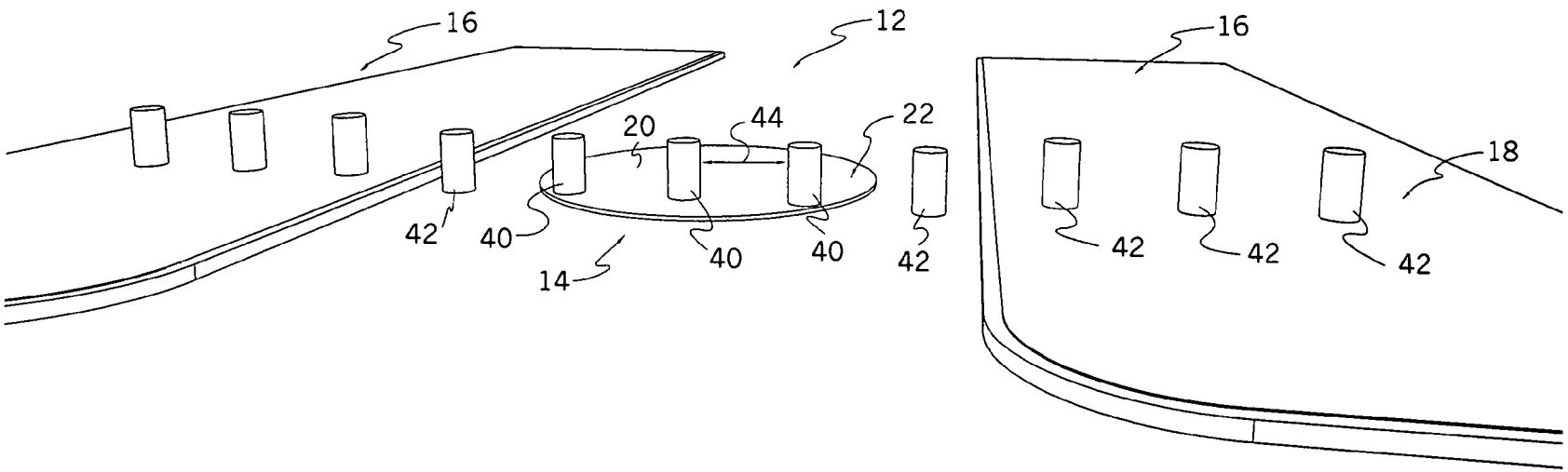
FIG. 1 is a schematic representation of a perspective view of a turntable barrier system according to one embodiment.
Figure 3:
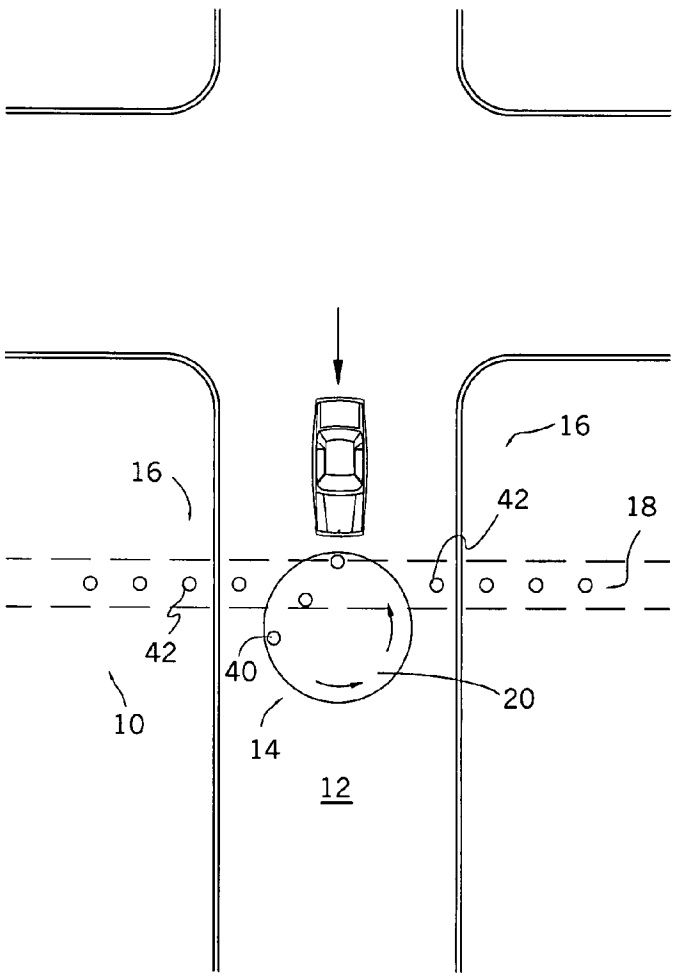
FIG. 3 is a schematic representation of a top view of the turntable barrier system of FIG. 1 in an intermediate position.
Figure 2:
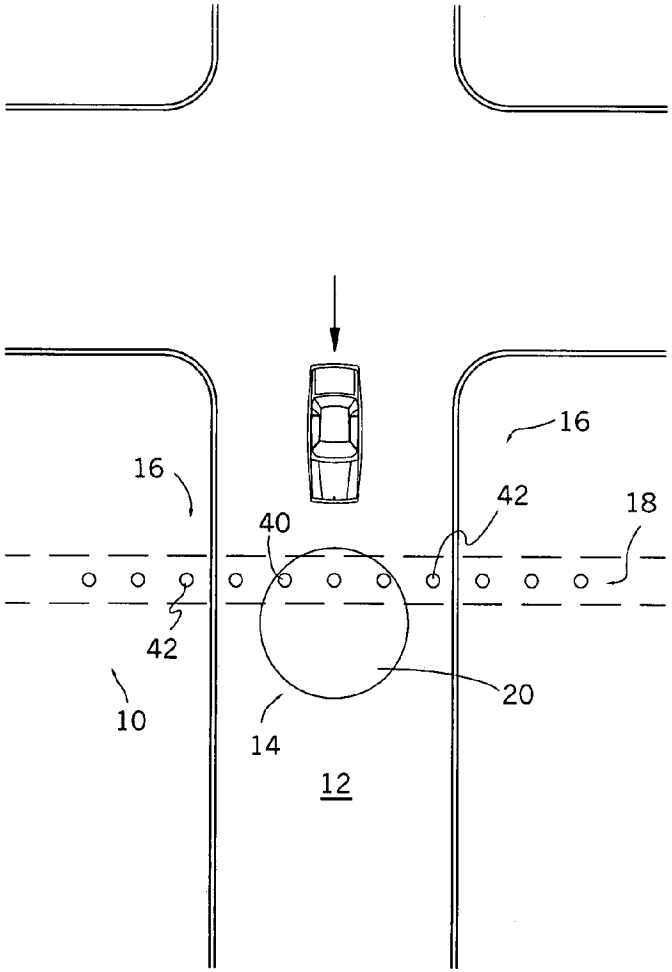
FIG. 2 is a schematic representation of a top view of the turntable barrier system of FIG. 1 in a first position.
Figure 5:
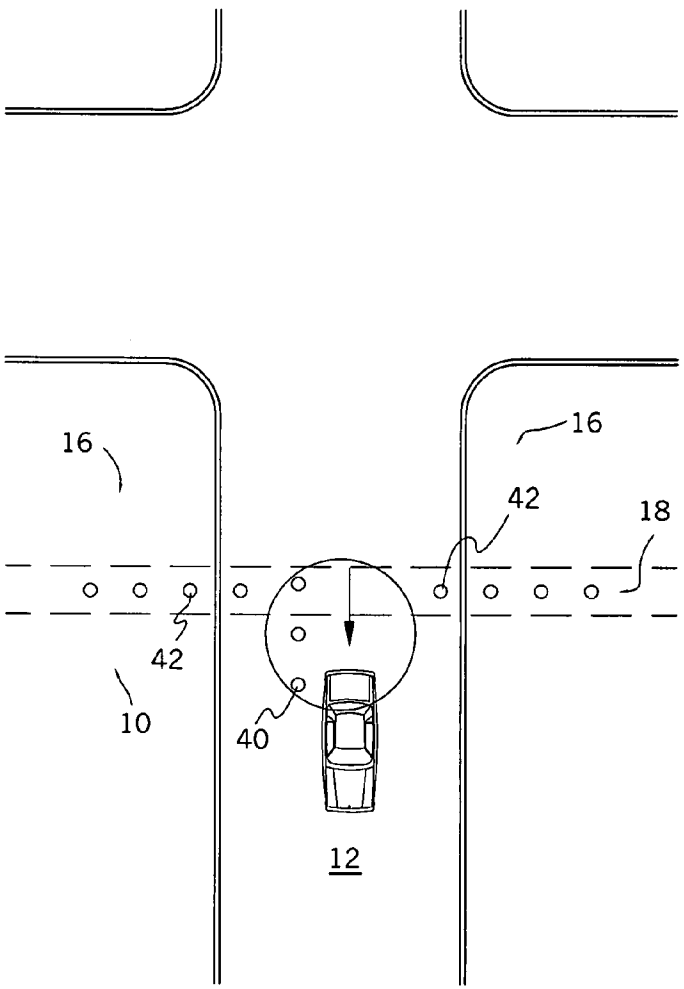
FIG. 5 is a schematic representation of a top view of the turntable barrier system of FIG. 1 in a second position.
Figure 4:
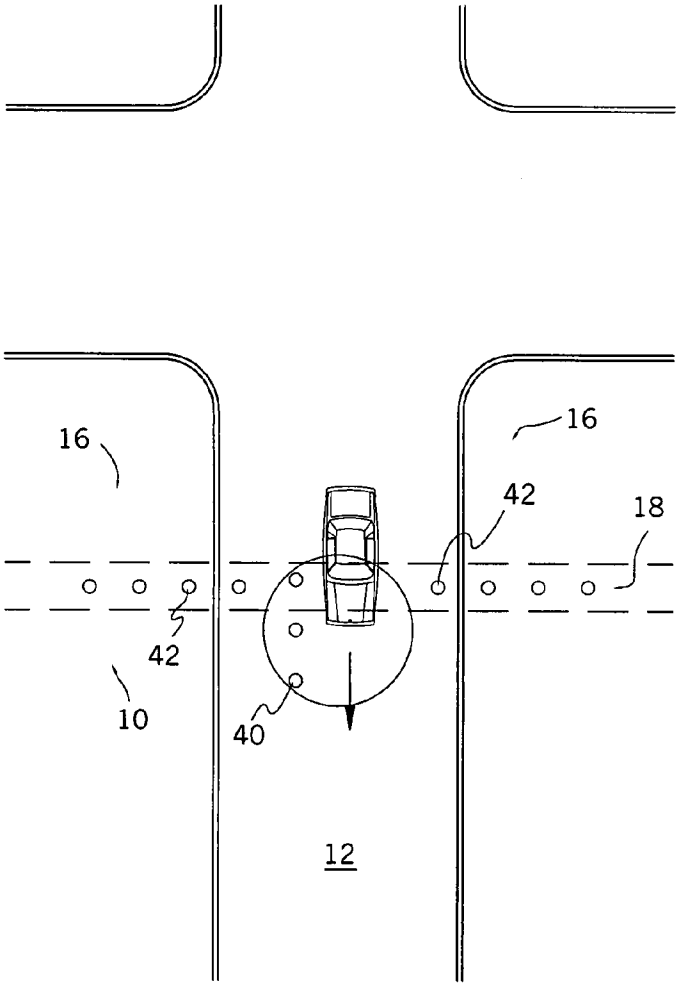
FIG. 4 is a schematic representation of a top view of the turntable barrier system of FIG. 1 in a second position.

According to the illustrated embodiment, the turntable barrier system provides an "operable" vehicle barrier that may be used in connection with an "inoperable" vehicle barrier to provide a controlled access point for vehicles within a security perimeter (e.g. for controlling access to protected facilities, buildings, restricted areas, etc.). The operable and inoperable barriers include impact elements (e.g. posts, weights, projections, obstacles, etc.) that are configured to arrest vehicles traveling at up to high rates of speed, according to pre-established crash barrier rating systems and/or criteria. The impact elements of the operable barriers are provided on a movable member (e.g. shown schematically as a turntable, rotatable platform, etc.) having a top surface generally planar with a surface such as a vehicle traffic surface (e.g. trafficable surface, roadway, driveway, parking facility, etc.). The top surface of the turntable is intended to be "generally planar" with the overall surface of the roadway to the extent practical, recognizing that the roadway maybe graded or contoured (such as, for example, "crowned" for drainage, etc.) so that a vehicle may travel across the top surface from the roadway in a relatively "smooth" manner. The turntable is configured for placement within a "pit" (e.g. pocket, recess, etc.) in the roadway and configured to rotate with the top surface generally within the plane of the roadway (e.g. horizontally, etc.) between a first position (e.g. closed position, secured position, etc.) with the impact elements extending upwardly and aligned to create a perimeter (such as, for example, a security perimeter, etc.) and prevent passage of vehicles, and a second position (e.g. open position, access position, passage position, etc.) where an opening is created within the security perimeter that is sufficient to permit passage of vehicles over the top surface of the turntable. Accordingly, the system is intended to position the turntable in the first position to maintain the security perimeter until activated for rotation to the second position to permit passage of an "authorized" vehicle, and then reactivated for rotation to the first position to restore the security perimeter. A drive system for the turntable is provided to permit operation (e.g. rotation) of the turntable from a remote location when activated, and to permit local operation of the turntable (e.g. manually, etc.) when necessary or desirable. According to an alternative embodiment, the movable platform may be configured for sliding movement, translational movement or the like. According to another alternative embodiment, the barrier may be configured for use with a perimeter for any suitable purpose, such as for changing traffic patterns, controlling access in the event of special occasions (e.g. emergencies, public events, etc.). According to a further alternative embodiment, the barrier system may be used in off-road type applications, such as parks, agricultural facilities, recreational or athletic fields, etc.

Figure 8B:
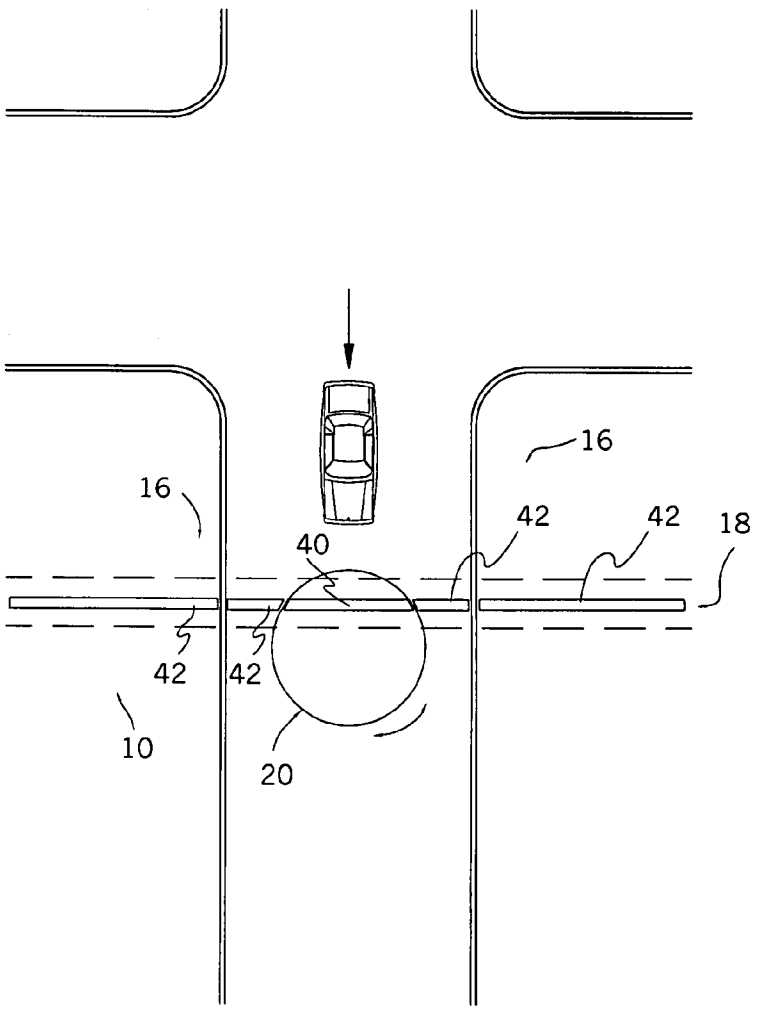
FIGS. 8A–8B are schematic representations of a top view of the turntable barrier system according to other embodiments.

The embodiment shown and described in the FIGURES includes impact elements configured for use with "operable" and as "inoperable" barriers that are configured to permit passage of pedestrians while preventing passage of vehicles. According to alternative embodiments, other forms of impact elements may be provided that restrict passage of both pedestrians and vehicles, or certain types of vehicles, when desirable for use in a particular application. For example, the impact elements may be provided as generally "solid" or "continuous" impact elements configured to prevent passage of pedestrians and vehicles (such as shown in FIG. 8B). By further way of example, the impact elements may be provided as discrete elements having a spacing sufficiently narrow to prevent passage by large vehicles (e.g. automobiles, trucks, busses, etc.), while providing enough clearance to permit passage of small vehicle (e.g. golf carts, motorcycles, bicycles, etc.).

Figure 9:
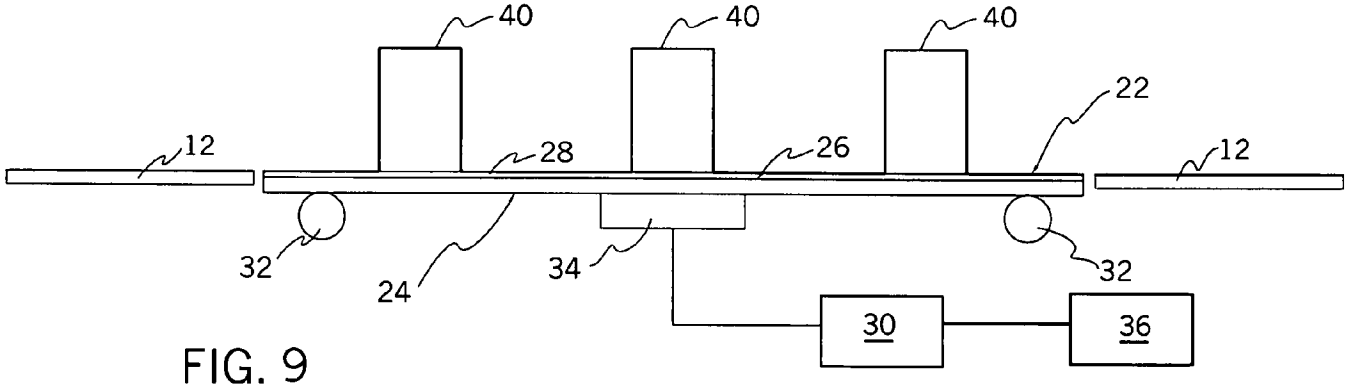
FIG. 9 is a schematic block diagram of a turntable barrier system according to an exemplary embodiment.

Referring to FIGS. 1 and 9, the turntable barrier system 10 is shown according to an embodiment. The system is shown to include a turntable 20 configured for use with a roadway 12, a drive system 30 to operate the turntable and an operable barrier 14 having impact elements 40, for use in coordination with an inoperable barrier 16 having impact elements 42 that form at least part of a border shown as a security perimeter 18 for an area or facility (or the like) to be protected (not shown). Impact elements 40 for the operable barrier 14 may be provided as "foundation" type impact elements where the structure of the impact element is integrated with the structure of the turntable and the foundation of the impact elements exists above, within, or below turntable 20. Such foundation type impact elements are intended to provide a relatively "heavy" ballast material below the surface of the turntable (or roadway) to minimize the volume of the impact elements above the roadway surface, thus increasing the ease of pedestrian access and minimizing visual obstructions along the security perimeter.

According to one embodiment, the foundation type impact elements are formed from a shell of material (e.g. steel, etc.) having a cavity containing a fill material (e.g. cement, reinforced concrete, metal, stone, wood, plastic, etc.). The shell may include internal braces (not shown), such as steel plates, to provide additional strength. The shell and fill material may be integrally formed with (or embedded within, etc.) the turntable (or roadway), so that loading from vehicle impact upon the impact elements can be transferred to the turntable and/or a foundation below or adjacent to the turntable. Use of foundation type barriers are generally desirable for "permanent" type barrier systems, in which the impact elements are intended to be present for an extended time period. According to a preferred embodiment the foundation impact elements include a steel shell filled with reinforced concrete and having a minimum cross section area of approximately 144 square inches. According to an alternative embodiment, the foundation impact elements may be provided in various shapes, sizes and materials. For example, the cross sectional area may be decreased with the use of higher strength materials or the cross sectional area may be increased with the use of lower strength materials, etc.

The impact elements 40 of the operable barrier 14 used in connection with turntable 20 may also be provided as "inertia" or "friction" type barriers that are intended to rely on their weight and friction with the top surface of the turntable to provide a desired degree of impact resistance. Such inertia type impact elements may be "preformed" concrete structures (such as commonly known as "jersey barriers") or concrete "planters" or the like that are intended for placement at a desired location on the surface of the turntable (or roadway). The inertia type impact elements are advantageous for "temporary" type barrier systems, in which the impact elements may only be required for a relatively short time period, or where subgrade conditions prevent easily constructing a foundation, as in the case of shallow depth utility lines, etc. However, such inertia type impact elements typically involve more material located above the surface of the roadway/turntable than foundation type impact elements which are integrated into a foundation.

Inertia type impact elements are also useful as inoperable barriers (e.g. "sidewalk" barriers, etc.—shown schematically as inoperable barrier 16) at locations along security perimeter 18 adjacent to turntable 20. Inertia type impact elements are not intrusive into the "bed" of the roadway (e.g. roadbed, sub grade, foundation, etc.). One characteristic of an effective inertia type impact element is the relatively large weight of the impact element. According to a preferred embodiment, the inertia type impact elements are provided with an outer shell material (such as, for example, bronze to enhance aesthetic appeal) and an internal ballast (e.g. concrete, metal, etc.) to provide a weight of approximately 6000 pounds (lbs) (such as for use in applications classified as "high threat" areas). According to a particularly preferred embodiment, the inertia type impact elements are provided in dimensions of approximately 30 inches high; 30 inches wide and 48 inches deep. According to alternative embodiments, the impact elements of the inoperable barriers may be provided as foundation type impact elements integrated into a foundation (e.g. sidewalk, roadway, ground area, subgrade foundation, etc.). According to another alternative embodiment, the inertia type impact elements may be provided in any suitable size, shape, weight and surface texture to provide the desired impact resistance for a particular application (such as, for example, a weight less than 6000 lbs. for use in applications classified as "low threat" etc.).

According to any preferred embodiment, the impact elements for the operable and/or inoperable barriers are the "foundation" type impact elements extending to a depth below the surface of the roadway (or turntable) a distance within the range of approximately 12 to 18 inches to minimize the amount of impact element material extending above the roadway/turntable surface when economically and physically practical, and when suited to the intended permanency of the application. However, use of only "inertia" type impact elements as both inoperable barriers and the impact elements of the operable barrier may be desirable when suggested by a temporary application, or other cost/practicality factors (such as, for example, where "shallow" utilities exist beneath the top surface of the roadway, etc.). According to a particularly preferred embodiment, the impact elements have a height of at least approximately 30 inches (preferably within the range of approximately 30 inches to 36 inches) extending from the top surface of the turntable (roadway) and are intended to make contact with the chassis of a vehicle (such as an automobile, truck, bus, etc.) upon impact. Impact elements 40, 42 are arranged in a pattern (shown schematically as an "array" or "line" or "row" or an "arc" etc.) having a spacing between the impact elements to provide a clearance 44. The clearance 44 is intended to be sufficiently large to allow a sizeable clearance for pedestrians (such as, for example, approximately 4 feet, etc.) and to correspond with clearances typically required to accommodate persons with disabilities (e.g. wheelchairs, etc.). The clearance is also intended to be sufficiently small to maximize resistance of the barrier system to impact from vehicles. For example, a spacing between the impact elements with a clearance of approximately 4 feet is intended to increase the likelihood that a vehicle, such as an automobile or the like, attempting to breach the perimeter will impact at least two impact elements.

Referring to FIGS. 1–8B, a turntable 20 is shown according to an embodiment. Turntable 20 is shown to include a movable (e.g. rotatable) member (e.g. platform, disc, etc.) having a generally circular shape with a top surface 22 configured to be located within a "pit" 15 or recess in roadway 14 such that top surface 22 is approximately coplanar with a surface of the roadway. The turntable is intended to provide a rotatable surface, such as are commercially available from various manufacturers. The turntable includes a frame structure portion 24 including a deck plate 26, which may be formed in separate sections from a material (e.g. steel, etc.) and assembled using a conventional techniques (e.g. bolting, welding, riveting, etc.). Turntable 20 is shown as a generally circular member configured for rotation relative to the roadway. The frame structure portion of the turntable may include radially extending supports (e.g. beams, joists, etc.) extending from a central location to an outer edge of the turntable (not shown). According to an alternative embodiment, the turntable may be provided in other shapes (e.g. rectangular, octagonal, etc.) and configured to rotate within a frame structure, or to be elevated above a frame structure for rotation. According to another alternative embodiment, the a platform may be provided that is configured for non-rotatable movement (e.g. sliding movement, translational movement, etc.).

Turntable 20 is also shown to include a pad layer 28 formed from a material (e.g. reinforced concrete having reinforcing steel generally in the plane of the pad layer, steel grating, etc.) above frame structure 24. The frame may include studs or other structure (not shown) around which the pad layer is formed or attached to increase the bond between the frame and the pad layer. For turntable vehicle barrier applications including the use of foundation type impact elements, a concrete pad layer may be integrally formed with the impact elements (such as by formation from concrete and sharing common reinforcing steel, embedded in the pad layer, etc.) so that the pad layer helps serve as the foundation ballast for the foundation type impact elements.

The components of the turntable may be formed as a single piece or as multiple pieces. According to one embodiment, the components of the turntable may be formed as a single piece that may be installed or removed from the roadway as a unit, such as, for example, when the pad layer is formed from a relatively lightweight material such as open (e.g. corrugated, etc.) steel grating, steel deck plate or the like. The steel grating or deck plates may include access locations for workers (e.g. "trap doors" or the like—not shown) to facilitate maintenance and repair of the turntable. According to another embodiment, the components of the turntable may be formed in separate sections (such as when the pad layer is formed from a relatively "heavy" material such as concrete) that are intended to facilitate installation of the turntable within a recess (e.g. pit, well, etc.) in the roadway, and to facilitate removal or replacement of all or certain sections (e.g. for access to utilities, or repair, maintenance, refurbishment, etc. of the turntable components, other subsurface devices, drive system and the like) such as by a crane or the like.

For turntable barrier applications including inertia and/or foundation type impact elements, the pad layer may be formed having a generally planar top surface available for placement of an aesthetic cover. The cover material could include one or any combination of cement, concrete, asphalt or tiled pavers such as brick, stone, cobble, metal grate, metal plate, tile, wood, rubber, plastic, glass, soil, plantings (such as grass) or the like. According to any embodiment, the cover material on the top surface may be provided as a material desired to "match" or correspond with a surrounding surface (e.g. roadway, sidewalk, ground, etc.).

According to an alternative embodiment, the turntable may be provided without a pad layer and may include only a steel deck or the like. According to another alternative embodiment, the turntable may be mounted on the surface of the roadway (e.g. without use of a pit or the like). For example, such a "surface mounted" turntable may be constructed above-grade and at least a portion of the surrounding surface of the roadway may be inclined or "ramped" to an edge of the top surface of the turntable. Such a surface mounted turntable may be secured (e.g. fixed, "pinned" etc.) to the roadway using suitable devices such as bolts, studs, pins, bars, etc. having sufficient shear strength to resist movement of the turntable upon impact and to minimize "uplift" in the event of impact.

Referring further to FIGS. 2–8B, impact elements 40 are arranged on top surface 22 of turntable 20 in a pattern to provide an operable impact barrier 14 configured for use with impact elements 42 that provide an inoperable impact barrier 16, that together are intended to form a security perimeter 18. Impact elements 40 may be foundation type elements or inertia type elements and may be located on turntable 20 in any desirable pattern and with any desirable spacing between the impact elements. As shown schematically in FIGS. 2–6, a series of impact elements 40 (shown, for example, as 3 impact elements) are arranged in a generally straight line (e.g. row of elements, etc.). According to a preferred embodiment, turntable 20 has a diameter of approximately 20 feet and the row of impact elements 40 having a spacing with a clearance 44 of approximately 4 feet and are arranged along a chord that perpendicularly intersects a radius of the turntable between its midpoint and an outside edge of the turntable. Locating the impact elements along a chord as shown in FIGS. 2–6 is intended to create an opening when the turntable is in the open position that is sufficiently large to permit passage of vehicles in either direction (e.g. unidirectional, one at a time, etc.) on a turntable having a size that is sufficiently small to permit economical and practical construction and operation. According to an alternative embodiment, the foundation type impact elements may be coupled to the turntable in any suitable manner (e.g. mechanical attachment (such as bolting, welding, etc.) to the frame, deck plate, etc.).

Figure 7:
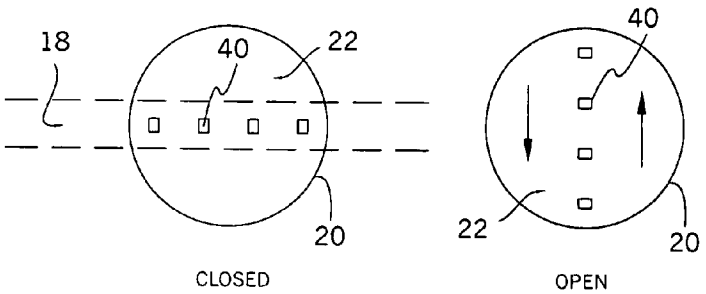
FIG. 7 is a schematic representation of a top view of the turntable barrier system according to another embodiment.
Figure 6:
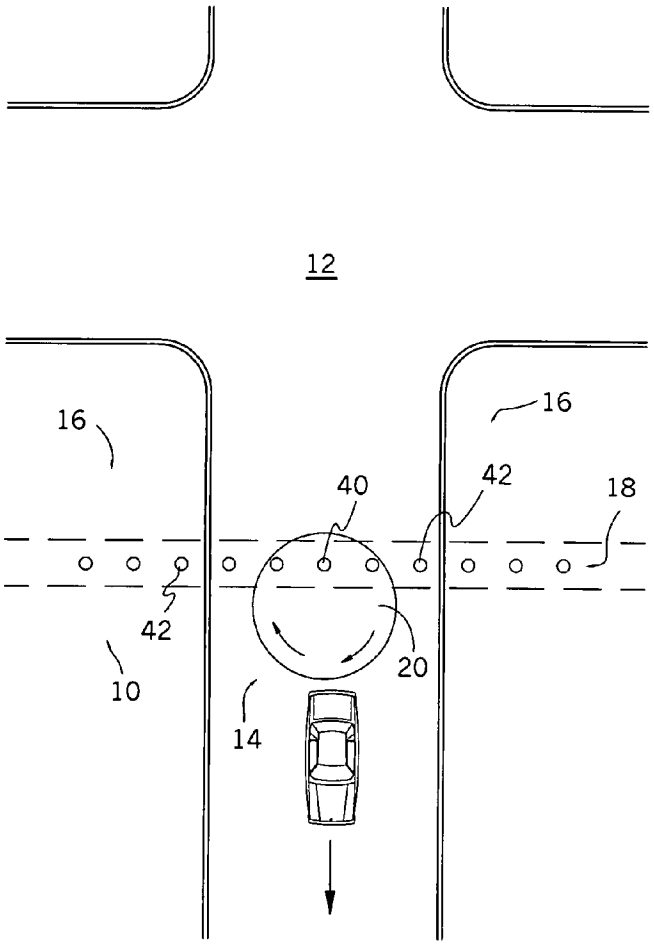
FIG. 6 is a schematic representation of a top view of the turntable barrier system of FIG. 1 in its original position.

Referring to FIG. 7, turntable 20 and impact elements 40 are shown according to another embodiment. Impact elements 40 are arranged on top surface 22 of turntable 20 in a pattern to provide an operable impact barrier 14. Impact elements 40 may be foundation type elements or inertia type elements and are shown schematically as a series of impact elements (shown, for example, as 4 impact elements) arranged in a generally straight line located approximately along a diameter of turntable 20. Locating the impact elements along an approximate diameter as shown in FIG. 7 is intended to create an opening when the turntable is moved to the open position that permits passage of vehicles in both directions (e.g. simultaneously, bidirectional traffic flow, etc.). The diameter of the turntable may be any suitable size as necessary to accommodate vehicles of an intended or anticipated size.

Figure 8A:
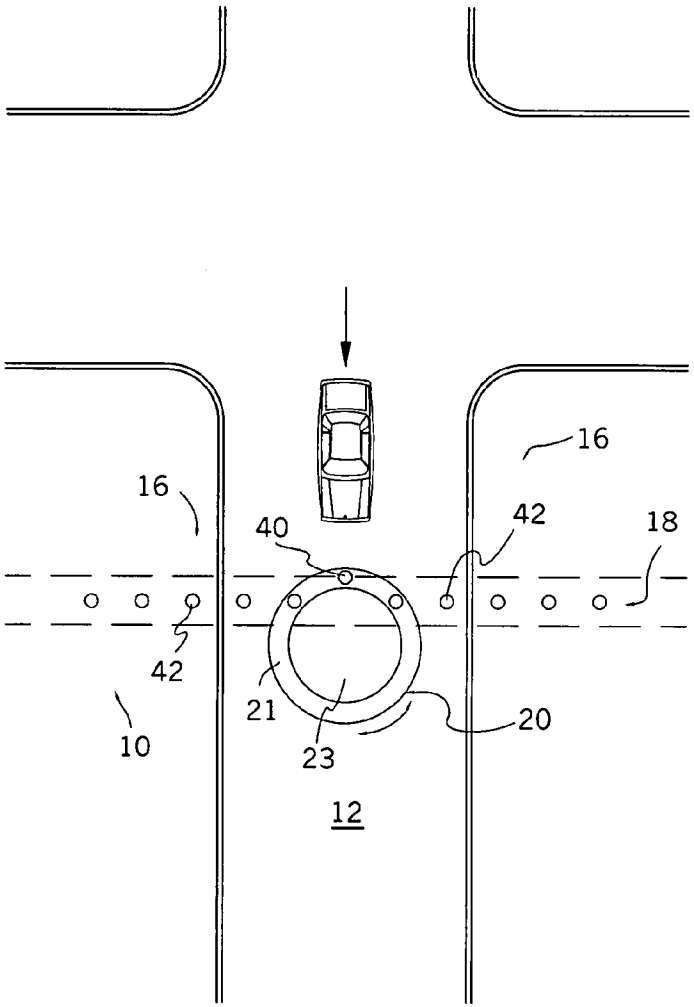

Referring to FIG. 8A, turntable 20 is shown according to another embodiment. Turntable 20 includes a movable portion 21 and a stationary portion 23. Movable portion 21 is shown schematically as a generally circumferential or peripheral ring on turntable 20. Stationary portion 23 is shown as a generally central "core" area substantially surrounded by movable portion 21. One or more impact elements (shown, for example, as three impact elements) may be provided in a pattern (shown, for example, as an arc or a "curve") on movable portion 21. The drive system is configured to rotate movable portion 21 relative to roadway 12 and stationary portion 23 so that movement of movable portion 21 from the first position to the second position creates an opening that permits passage of vehicles across the perimeter 18.

Referring to FIG. 8B, turntable 20 is shown according to another embodiment. Turntable 20 includes operable impact elements 40 shown in the form of a "continuous" element configured to prevent passage of pedestrians and vehicles. Impact elements 40 are shown aligned with inoperable impact elements 42 (shown as continuous elements) along perimeter 18 to provide a border with controlled access for both vehicles and passengers.

According to any preferred embodiment, the turntable and impact elements are configured to provide an operable barrier that can be moved (e.g. rotated, translated, repositioned, etc.) to alternately prevent (i.e. the closed position) and permit (i.e. the open position) passage of vehicles (such as at a security checkpoint along a "border" such as a security perimeter or the like). Turntable 20 is configured to rotate generally in the plane of the roadway (i.e. configured for a relatively "smooth" transition for vehicle access between the roadway and the top surface of the turntable as the vehicle crosses over the top surface). The amount of rotation is shown schematically as approximately 90 degrees beginning at the closed position to prevent vehicle passage (such as where the impact elements on the operable barrier are generally parallel with the adjacent impact elements of the inoperable barrier along the security perimeter) to the open position to permit vehicle passage (such as where the impact elements on the operable barrier are generally perpendicular to the adjacent impact elements of the inoperable barrier). The turntable may also be configured to rotate in a first direction from the closed position to the open position and in a second (i.e. opposite the first direction) to return from the open position back to the closed position. The turntable may also be configured to rotate only in one direction (i.e. clockwise or counterclockwise) in approximately 90 degree increments to alternately prevent and permit passage of vehicles.

Figure 10:
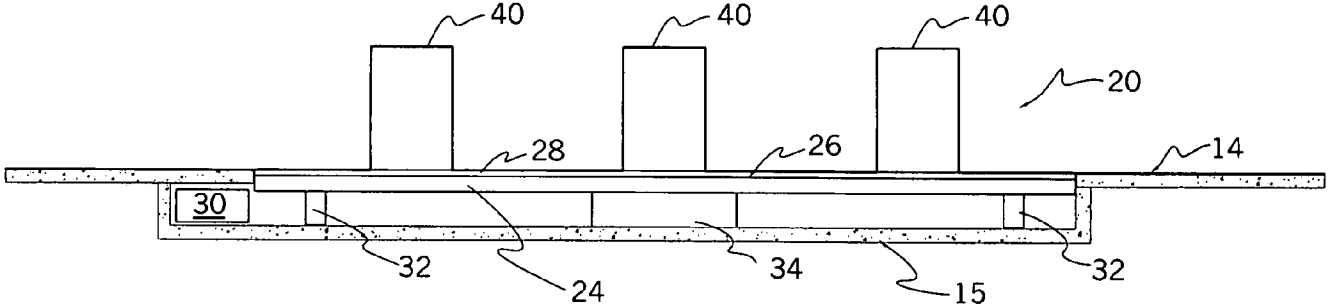
FIG. 10 is a schematic representation of a side view of a turntable barrier system according to an exemplary embodiment.

Referring to FIGS. 9 and 10, a drive system 30 for the turntable vehicle barrier system is shown according to an embodiment. Drive system 30 includes rotation elements 32 (e.g. wheels, castors, beveled castors, ball bearings, roller bearings, pipes, viscous fluid bearings, etc.) that travel or "run" along a predetermined "path," with or without a track (such as a steel track or rail—not shown) beneath the turntable so that the turntable is capable of moving (e.g. rotating, etc.) about a central axis on the rotation elements. The rotation elements may also include wheels, such as railroad car wheels, roller coaster car wheels and the like, that are coupled to the frame support structure of the turntable. According to an alternative embodiment, the rotation elements may be coupled to the foundation of the roadway or pit and configured to engage structure on the turntable.

Referring further to FIGS. 9 and 10, drive system 30 also includes a driving device (such as, for example, an electric motor which may be capable of operating with an electrical power supply, or a hydraulic mechanism, etc.). Drive system 30 interfaces with a motion transfer system 34 coupled to turntable 20 and including suitable motion transfer devices (e.g. pulleys, gears, belts, chains, etc.—not shown) of a conventional type configured to operably engage turntable 20 for transferring rotational motion from drive system 30 to turntable 20. Drive system 30 also interfaces with an activation system 36 configured to control the operation of drive system 30 and movement of turntable 20.

Activation system 36 includes appropriate instrumentation and switching devices of a conventional type (such as switches, contacts, relays, circuits, actuators, etc.—not shown) that are configured to control operation of the turntable from a remote location (e.g. security post, etc.—not shown) by energizing the driving device to rotate the turntable and de-energizing the driving device to stop the turntable. Drive system 30 also includes a device having the capability for manual "override" of the driving device (e.g. in the event of a malfunction, maintenance or the like) in which the driving device is disengaged from the turntable so that the turntable may be manually rotated locally (e.g. by manually "pushing," hand-crank, lever, etc.—not shown). According to an alternative embodiment the rotational elements may include a series of rolling elements (e.g. pipes, etc.) arranged in a radial array within a base of the turntable and intended to improve weight distribution of the bearing load of the system.

According to any preferred embodiment, the drive system is intended to provide a power-operated system having sufficient torque for rotating the turntable at a suitable rotational speed (such as, for example, one revolution per minute) and in approximately 90 degree increments (or any other suitable increment) to open and close a vehicle access point within the security perimeter. The system provides rotational elements intended to minimize friction between the turntable and a supporting base surface (e.g. foundation, pit bottom, road bed, etc.). The system further includes control features such as an activation system to selectively "start" and "stop" the motion of the turntable from a remote location, and to "override" or otherwise disengage the driving device from the turntable so that the turntable is also capable of local, manual operation.

According to any exemplary embodiment of the present invention, the turntable barrier system is intended to provide a "movable" barrier for use along a boundary or border such as a security perimeter or the like for selectively permitting and preventing vehicle access along a trafficable surface such as a roadway extending through the perimeter. The turntable is configured to rotate in a plane generally parallel to the roadway such that vehicles may drive across the top surface of the turntable when the turntable is in an open position. The turntable includes impact elements (either foundation type or inertia type) coupled to (e.g. integrally formed with, mechanically attached to, resting on, etc.) and extending from the top surface to provide an obstacle intended to arrest the progress of a vehicle traveling at a predetermined rate of speed. The turntable barrier system is intended to provide a movable barrier having a "rating" as a crash type barrier consistent with applicable governmental rating criteria. For example, the turntable vehicle barrier system is intended to provide a rating of at least any one of the following K ratings (i.e. a measure of the barrier's potential to arrest a vehicle at escalating speeds) and L ratings (i.e. a measure of the distance at which a barrier can stop a vehicle) as dictated by standards determined by the U.S. Department of State: K4 (15,000 lb vehicle traveling at 30 miles per hour (mph)), K8 (15,000 lb. vehicle traveling at 40 mph), K12 (15,000 lb. vehicle traveling at 50 mph), L3 (less than 3 feet), L2 (within a range of 3 to 20 feet) and L1 (within a range of 20 to 50 feet).

It is also important to note that the construction and arrangement of the elements of the turntable barrier system as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes, profiles and proportions of the various elements, values of parameters, mounting arrangements, use of materials, ballast, orientations, etc.) without materially departing from the novel teachings and advantages of the subject matter recited. For example, elements shown as integrally formed may be constructed of multiple parts or elements show as multiple parts may be integrally formed, the operation and positioning of the turntable may be reversed, reconfigured or otherwise varied, the diameter and depth of the turntable and the related components of the system may be varied, the impact elements may be connected to the turntable and roadway in any suitable manner that provides desirable crash rating performance. Further the size, shape, weight, composition and nature or number of impact elements provided in the system may be varied. It should be noted that the turntable and impact elements of the system may be constructed from any of a wide variety of materials that provide sufficient strength, durability, longevity and/or impact resistance. It should also be noted that the system may be used in association with a wide variety of applications (e.g. corporations, government facilities, entertainment venues, private residences, hospitals, hotels, etc.) and that the impact elements of the system may be provided in any suitable size, shape, material and appearance that meets applicable design and performance standards and that creates a desired appearance corresponding to the location of the system. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. An operable barrier system for vehicles, comprising:
- a turntable configured for use with a trafficable surface;
- at least one impact element disposed on the turntable; and
- a drive system configured to rotate the turntable along a plane of the trafficable surface between a first position configured to prevent passage by vehicles and a second position, approximately 90 degrees from the first position, configured to permit passage by vehicles.

2. The system of claim 1 wherein the turntable is recessed within the roadway to provide a generally circular top surface substantially coplanar with the trafficable surface.

3. The system of claim 1 wherein the turntable is placed on a finished grade of the trafficable surface and a ramp surface is provided between the turntable and the trafficable surface.

4. The system of claim 1 wherein the at least one impact element is multiple impact elements arranged in a line along a chord of the top surface.

5. The system of claim 1 wherein the at least one impact element is multiple impact elements arranged in a line along a diameter of the top surface.

6. The system of claim 5 wherein the impact elements separate a first traffic path from a second traffic path when the turntable is in the second position.

7. The system of claim 1 wherein the at least one impact element is multiple impact elements arranged along an arc.

8. The system of claim 7 wherein the turntable further comprises a movable ring portion and the impact elements are arranged on the ring portion.

9. The system of claim 1 wherein the impact element has a height sufficient to contact a structural element of a vehicle in the event of an impact.

10. The system of claim 1 wherein the at least one impact element is a substantially continuous impact element configured to restrict passage by pedestrians.

11. The system of claim 1 wherein the at least one impact element is multiple impact elements having a spacing therebetween sufficient to permit passage by pedestrians but to restrict passage by vehicles.

12. The system of claim 1 wherein the impact element is a removable element configured to rest on the top surface.

13. The system of claim 1 wherein the impact element is structurally integrated with the turntable.

14. The system of claim 1 wherein the drive system is configured for remote movement of the turntable in a first mode and for manual movement of the turntable in a second mode.

15. The system of claim 1 wherein the trafficable surface is a ground surface and the turntable further comprises soil and plantings.

16. A method of providing an operable vehicle barrier for use with a roadway to control passage of vehicles, comprising:

providing a turntable device having a top surface;

mounting at least one impact element on the top surface; and providing a drive system capable of rotating the turntable device in a plane that can be driven across by vehicles from the roadway thereby selectively permitting passage or blockage of vehicles through the barrier.

17. The method of claim 16 wherein the method further comprises providing an actuation device capable of activating the drive system for rotation of the turntable device.

18. The method of claim 16 wherein the drive system further comprises an electric motor.

19. The method of claim 16 wherein the drive system further comprises a hydraulic mechanism.

20. The method of claim 16 wherein the drive system further comprises a manual device.

21. The method of claim 16 further comprising integrally forming the impact elements with a portion of the turntable device.

22. The method of claim 16 further comprising mechanically attaching the impact elements to the turntable device.

23. The method of claim 16 wherein the impact elements are inertia type impact elements.

24. The method of claim 16 further comprising arranging the impact elements substantially in a row along one of a diameter, a chord or an arc of the turntable device.

25. The method of claim 16 further comprising establishing a rating for the operable vehicle barrier.

26. A rotatable barrier system for vehicles, comprising:

a turntable configured for mounting in a generally planar relationship with a trafficable surface, the turntable having at least one impact element disposed thereon; and a drive system coupled to the turntable and having at least one of a power operated mode and a manually operated mode to rotate the turntable from a first position where the impact element is configured to block passage of vehicles and a second position where the impact element is configured to permit passage of vehicles.

* * * * *